US008821606B2

(12) United States Patent
Ujihashi et al.

(10) Patent No.: US 8,821,606 B2
(45) Date of Patent: Sep. 2, 2014

(54) METAL BONDED GRINDING STONE, AND METHOD OF MANUFACTURING THE SAME

(75) Inventors: Masato Ujihashi, Tochigi (JP); Toshiya Hirata, Tochigi (JP); Kazuhiko Kitanaka, Tochigi (JP); Naohide Unno, Tochigi (JP); Hiroshi Sugiyama, Tochigi (JP); Noriyuki Namba, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 234 days.

(21) Appl. No.: 13/384,676

(22) PCT Filed: Jul. 21, 2010

(86) PCT No.: PCT/JP2010/062257

§ 371 (c)(1), (2), (4) Date: Jan. 18, 2012

(87) PCT Pub. No.: WO2011/010670

PCT Pub. Date: Jan. 27, 2011

(65) Prior Publication Data

US 2012/0137596 A1 Jun. 7, 2012

(30) Foreign Application Priority Data

Jul. 21, 2009 (JP) ..... 2009-170010
Jul. 21, 2009 (JP) ..... 2009-170017
Jul. 21, 2009 (JP) ..... 2009-170018

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09K 3/14*** | (2006.01) |
| ***B24D 3/02*** | (2006.01) |
| ***C09C 1/68*** | (2006.01) |
| ***B24D 3/06*** | (2006.01) |

(52) U.S. Cl.

CPC ..... *B24D 3/06* (2013.01); *B24D 18/0009* (2013.01); *B24D 33/086* (2013.01)

USPC ..... 51/309; 51/293; 51/307

(58) Field of Classification Search

USPC ..... 51/309, 293, 307

See application file for complete search history.

(56) References Cited

U.S. PATENT DOCUMENTS

| | | | | |
|---|---|---|---|---|
| 4,671,021 | A * | 6/1987 | Takahashi et al. | 451/540 |
| 7,563,294 | B2 * | 7/2009 | Rosenflanz | 51/309 |
| 2009/0084042 | A1 * | 4/2009 | Ramanath et al. | 51/296 |

FOREIGN PATENT DOCUMENTS

| | | | |
|---|---|---|---|
| JP | 53-008950 | B | 4/1978 |
| JP | 58-217271 | A | 12/1983 |
| JP | 03-264263 | A | 11/1991 |
| JP | 2002-046070 | A | 2/2002 |
| JP | 2004-249384 | A | 9/2004 |
| JP | 2008-229794 | A | 10/2008 |

* cited by examiner

*Primary Examiner* — James McDonough

(74) *Attorney, Agent, or Firm* — Carrier Blackman & Associates, P.C.; Joseph P. Carrier; William D. Blackman

(57) ABSTRACT

A metal bonded grinding stone is manufactured by heating and pressurizing a material including abrasive grains, a cobalt, a tungsten disulfide and a copper tin alloy to obtain a sintered product, and rapid-cooling the sintered product.

3 Claims, 10 Drawing Sheets

METAL BONDED GRINDING STONE, AND METHOD OF MANUFACTURING THE SAME

TECHNICAL FIELD

The present invention relates to a metal bonded grinding stone suitable for a plateau honing process and a method of manufacturing the same.

BACKGROUND ART

Recently, efforts have been made to the environment in all areas. Even in vehicles, improving of fuel efficiency is a critical matter to be addressed. One of the measures to improve the fuel efficiency is reducing of the friction between a piston and a cylinder. This reduction in the friction is colligated with an enhancement in an operation performance as well as an enhancement in the fuel efficiency.

To achieve the above-mentioned friction reduction, a plateau honing method is effective. FIG. 10 is an enlarged schematic cross-sectional view of a plateau honed cylinder, and a cylinder 100 having been subjected to the plateau honing process is formed on a surface thereof with countless plateaus (Hill) 101 and valleys 102 formed between the adjacent plateaus 101, 101. A top surface 103 of the plateau 101 is low in its surface roughness thereby achieving less wear and allowing oil pooled in the valley 102 to maintain the lubrication between the piston and the top surface 103. As a result, both sliding characteristic and lubrication there-between may be realized.

As a grinding stone suitable for the plateau honing process as described above, a metal bonded grinding stone has been proposed (for example, see Patent Document 1).

In paragraph [0049] of Patent Document 1, there has been described "manufacturing conditions are that a temperature for sintering the grinding stone including barium sulfate (BaSO4) according to an embodiment is 500° C. and a molding pressure is 15 MPa. All of the grinding stones according to an illustrative embodiment have been prepared by simultaneously heating and pressing (hot press) mixed powders having been formulated".

In the present invention, a metal bonded grinding stone material is sintered under the above-mentioned sintering conditions (500° C., 15 MPa). After sintering, although not described in Patent Document 1, the metal bonded grinding stone is obtained by stopping supplying of electric power to a heater to cool the material. In this case, the cooling rate is 5.8° C./min. A schematic cross section of the metal bonded grinding stone thus obtained is as follows.

FIG. 11 is a schematic sectional view of a related metal bonded grinding stone. In the metal bonded grinding stone 110, although it is given on the basis that cobalt (Co) grains 111, abrasive grains 112 of about 5 μm, and tungsten disulfide (WS2) grains 113 are dispersed in a metallic binder Mb, it has been found that agglomerates of about 30 μm are contained therein.

Due to insufficient dispersion of the filler which is added to improve mechanical properties, the agglomerates 115 are generated by the agglomeration of the filler cobalt grains 113 and tungsten disulfide grains 113 in a coarse crystal of the metallic binder Mb. Such agglomerates 115 are weak compared with the surrounding area.

FIG. 12 is an explanatory diagram of an action of the metal bonded grinding stone shown in FIG. 11. As a result of a grinding action having been performed with the metal bonded grinding stone 110 for a while, the agglormerates 115 are wandered from the surface thereof, and large pockets 116 having a grain size of about 30 μm are thereby generated. For this reason, the retentivity thereof becomes low thereby the quantity of grinding decreases as abrasive grains are progressively wandered and a sudden increase in abrasion thereof is generated as the agglomerates are progressively wandered. Accordingly, there is a problem that a related metal bonded grinding stone has a short life.

Also, claim 1 of Patent Document 1 recites "a super abrasive grain metal bonded grinding stone which is made by sintering and integrating soft abrasive grains containing super abrasive grains and barium sulfate which are dispersed in a sinterable metal bond containing metallic grains and glassy grains", and claim 2 of Patent Document 1 recites "a sinterable metal bond consisting of 25 to 75 volume % metallic grains and 25 to 75 volume % glassy grains . . . ".

Also, regarding metallic grains, it is described on paragraph [0046] of Patent Document 1 that alloy powders or mixed powders of copper (Cu) and tin (Sn) may be employed as metallic grains.

The alloy powders or mixed powders of copper (Cu) and tin (Sn) are substances that melt during sintering. As a result of reviewing the substances, the content ratio of the molten substances has been found to affect a life expectancy of the grinding stone. That is, as shown in Patent Document 1, when the content ratio of the molten substances is selected in a wide range of 25 to 75 volume %, it has been proved that variation in its life expectancy happens. Since the life expectancy of the grinding stone significantly affects productivity and production planning in a grinding process, it is necessary to stably extend the life.

Also, a table appears on paragraph [0051] of Patent Document 1. Volume ratios (%) in the grinding stone are described on lines 10 to 12 in the table as 6.2 volume % and 18.8 volume % hard abrasive grains, 12.2 to 34.7 volume % soft abrasive grains and 59.1 to 81.6 volume % binders, according to the embodiments 1 to 7. Also, it is described that the hard abrasive grains are CBN or SD (diamond) on line 3 in table 1 and the soft abrasive grains are barium sulfate (BaSO4) on line 4 in table 1.

It is described on paragraph [0031] of the same document that the preferable sizes of the super abrasive grains representative by CBN and diamond are 1 to 200 μm. Also, it is described on line 6 of paragraph [0034] in the document that the preferable grain sizes of barium sulfate are 5 to 10 μm.

It is described on paragraph [0035] of the same document that metallic grains and glassy grains are mixed as a bond (binding agent) and the sizes of the metallic grains are 1 to 50 μm. Also, it is described at the end of paragraph [00387] of the same document that the average grain sizes of the glassy grains are 3 to 5 μm.

It is described on line 2 of paragraph [0046] of the same document that metallic grains may employ alloy powders or mixed powders of copper and tin. An object of mixing metallic grains and glassy grains is described in the same document. The foregoing descriptions are listed in table 1 as follows for convenience.

TABLE 1

| Classification | Sorts | Mixing purpose | Material Example | Grain size | Mixing ratio (volume %) |
|---|---|---|---|---|---|
| Abrasive grains | Super abrasive grains | — | CBN, diamond | 1 to 200 μm | 6.2 to 18.8% |

TABLE 1-continued

| Classification | Sorts | Mixing purpose | Material Example | Grain size | Mixing ratio (volume %) |
|---|---|---|---|---|---|
| | Soft abrasive grains | Enhancement in a discharge property of cutting powders | Barium sulfate | 5 to 10 μm | 12.2 to 34.7% |
| Metal bonds (binding agent) | Metallic grains | Reinforcement in wear resistance | Copper tin alloy | 1 to 50 μm | 59.1 to 81.6% |
| | Glassy grains | Promotion of chip pocket | Glass, silica | 3 to 5 μm | |

That is, it is described that the soft abrasive grains are mixed for the purpose of enhancing a discharge property of cutting powders, the metallic grains play a role of reinforcing the wear resistance, and the glassy grains play a role of accelerating formation of chip pockets.

Incidentally, the metal bonded grinding stone of Patent Document 1 is provided for a finishing honing process of an inner face of a cast-iron engine cylinder for a vehicle (paragraph [0030]). The Mohs hardness of cast-iron as a material to be cut and the Mohs hardness of material forming a grinding stone have been tested. This test is performed to predict what phenomenon is occurred when other substances contact-slide thereon. If the hardness thereof is known, it can be predicted which one is abraded. The Mohs hardness of cast iron is 4, the Mohs hardness of barium sulfate is 3 to 3.5, the Mohs hardness of copper and tin alloy is 3 to 4, and the Mohs hardness of glass is 5 to 7.

Generally, the process of the formation and growth of chip pockets may be explained as follows. That is, when the cast iron is ground by abrasive grains, cast iron powders (cutting powders) are generated. These cast iron powders attack and wear bond around the abrasive grains while being discharged. As a result, the chip pockets are formed and grow around the abrasive grains. According to Patent Document 1, the glassy grains as a causing material of promoting the chip pocket are harder than the cast iron (cast iron: 4, glass: 5 to 7). For this reason, the wear caused by the contact sliding of the cutting powders and glassy grains cannot be expected, and the sufficient formation and growth of the chip pockets cannot also be expected.

In the plateau honing process, valley portions and mountain portions are formed by a defective honing process, thereafter, the mountain portions only are removed during a finishing process thereby forming a hill shape. For that reason, a processing margin in the finishing process is as small as several-micrometer (μm) length. In a case where the processing margin is more than the several-micrometer length in the finishing process, even the valley portions generated by the previous rough honing process are also removed, thereby becoming a generally simple honing surface.

Here, although the super-abrasive grains corresponding to a processing margin of several-micrometer length need to be less than 10 μm, however large it may be, less than 15 μm, it is described in Patent Document 1 that the super-abrasive grain size is 1 to 200 μm. If the super-abrasive grain size is large so, since the quantity of grinding increases and the valley portions are accordingly eliminated, a preferable hill shape is not formed.

Also, regarding the grain size of barium sulfate that is used for the purpose of enhancing the discharge property of cutting powders, it is described in Patent Document 1 that the grain size of barium sulfate is 5 to 10 μm. This causes the super abrasive grains, which play a substantial grinding role, to be wandered. A detailed description will be made below. The super abrasive grain is maintained in a state of being surrounded by a metal bond as a complex. Considering this state, the exposure ratio (the quantity of protrusion) of the super abrasive grain becomes a maximum of 50% (diameter ratio, 50%=radius). In other words, no matter how strongly the super abrasive grain is maintained by a metal bond, the super abrasive grain is wandered at a point of time when the exposure ratio (the quantity of protrusion) is more than 50%.

It is described on paragraph [0022] of Patent Document 1 that when the glassy elements of a sinterable metal bond are collapsed and a chip pocket is thereby generated, the mixed barium sulfate serves to enhance the discharge property thereof due to the fluidity of the collapsed grain pieces.

Here, the grain sizes of super abrasive grain/barium sulfate/glassy grain will be described. The mark resulting from the collapse and falling of the glassy grain becomes a pocket of at least 3 to 5 μm (size of glassy grain). A number of such marks exist, as a result, the barium sulfate is wandered (it is described in Patent Document 1 that the fluidity is enhanced). However, the grain size of barium sulfate is 5 to 10 μm, when the barium sulfate is wandered, chip pockets of 5 to 10 μm are also generated. This is nearly identical in its grain size to that of the super abrasive grain performing a grinding.

That is, chip pockets having an equivalent size to that of the super abrasive grain (meanwhile, as shown in paragraph [0010] of Patent Document 1, the barium sulfate does not have the cutting property) exist. The chip pockets which are generated by an attack of cutting powders and play a role of accelerating discharging of the cutting powders are naturally generated in the surroundings of the super abrasive grains. However, a protrusion limit of the super abrasive grain is 50% of its grain size, in contrast, since the wandered marks of barium sulfate are too large as 5 to 10 μm, the super abrasive grains are easily wandered.

The wandering of the super abrasive grains of cutting blade causes the grinding ratio (life of grinding stone) to be lowered. Also, if the wandering gradually proceeds, the grinding stone performs a process in a state where the number of the super abrasive grains is small, thereby causing the efficiency of grinding (grinded volume per process hour) to be lowered.

Also, as shown in Table 1, although the mixing ratio of binder agents of 59.1 to 81.6 volume % has been calculated as the sum of metallic grains and glassy grains, the metallic grains and glassy grains are mixed in a ratio of 6:4 (embodiment of Patent Document 1). Then, the mixing ratio of glassy grains becomes about 23.6 to 32.6 volume %. If the mixing ratio of 12.2 to 34.7 volume % of barium sulfate is added to the mixing ratio of glassy grains for each embodiment, the mixing ratio becomes 41.7 to 58.3 volume %.

In such a manner, since the glassy grains and barium sulfate are wandered in a large number as described in the foregoing and the wear of grinding stone is thereby proceeded, it is concerned that the grinding ratio (life expectancy of grinding stone) is lowered.

However, since the life expectancy of grinding stone does not so affect the productivity and production planning in the grinding process, there is a need to stably increase the life expectancy thereof.

PRIOR ART DOCUMENT

Patent Document

Patent Document 1: JP-A-2008-229794

SUMMARY OF INVENTION

One or more embodiments of the present invention provide a metal bonded grinding stone having a long life and a manufacturing method thereof.

In accordance with one or more embodiments of the present invention, a metal bonded grinding stone is provided with: abrasive grains; a cobalt; a tungsten disulfide; and a metallic binder. Agglomerates in which the tungsten disulfide, the cobalt and the metallic binder are agglomerated are included in the metal bonded grinding stone. A maximum grain size of the agglomerates is less than 15 μm.

The maximum grain size of the agglomerates may be less than 10 μm.

In the above structure, the metal bonded grinding stone includes agglomerates in which tungsten disulfide and metal binder are agglomerated, and the average size (average value of maximum grain sizes) of the agglomerates is less than 15 μm. If the size of agglomerates is less than 15 μm, a high grinding ratio may be obtained thereby increasing the life of grinding stone.

Also, if the size of agglomerates is less than 10 μm, a higher grinding ratio may be obtained thereby furthermore increasing the life of grinding stone.

Moreover, in accordance with one or more embodiments of the present invention, a metal bonded grinding stone is provided with: abrasive grains; a cobalt; a tungsten disulfide; and a copper tin alloy as a binder. A content ratio of the copper tin alloy is 20 to 40% by volume as a whole.

According to the above structure, the content ratio of copper tin alloy is limited to 20 to 40 volume % as a whole. The molten substance (copper tin alloy) is a binder by which non-molten substances (abrasive grains, cobalt grains, and tungsten disulfide grains) are connected to each other. The best volume percentage of the molten substance is 30% by volume. Then, it can be presumed that the space ratio (coincide with a space occupied by binders) of the non-molten substances is 30% by volume.

If the molten substances under 20 volume % exist in a space of such 30 volume %, chinks (blowholes) are generated by 10 volume %. The more the chinks (blowholes) exist, the less the performance of the grinding stone. Also, although the molten substances of more than 40 volume % try to penetrate into the 30 volume % space, the quantity of 10 volume % thereof remains as an excessive quantity and the excessive quantity thereof becomes a harmful inclusion. This inclusion causes an even dispersion of the non-molten substances to be hindered. Accordingly, the performance of the grinding stone is lowered.

The content ratio of copper tin alloy may be limited to the range of 20 to 40 volume % as a whole, and thereby a grinding stone having a long life may be obtained.

Moreover, in accordance with one or more embodiments of the present invention, a metal bonded grinding stone is provided with: abrasive grains; a cobalt; a tungsten disulfide; and a metallic binder. A content ratio of the tungsten disulfide is 0.25 to 0.5% by volume as a whole.

According to the above structure, the content ratio of tungsten disulfide is limited to 0.25 to 0.5 volume %. If the content ratio of tungsten disulfide is less than 0.25 volume %, both the grinding ratio and the grinding efficiency are lowered. Even though the content ratio of tungsten disulfide is more than 0.5 volume %, the grinding ratio and the grinding efficiency are also lowered. By limiting the content ratio of tungsten disulfide to 0.25 to 0.5 volume %, favorable grinding ratio and grinding efficiency can be obtained.

Furthermore, in accordance with one or more embodiments of the present invention, a metal bonded grinding stone is manufactured by: heating and pressurizing a material comprising abrasive grains, a cobalt, a tungsten disulfide and a copper tin alloy to obtain a sintered product; and rapid-cooling the sintered product.

In the above method, since the sintered product is rapid-cooled, the harmful agglomerates generated when the sintered product is slowly cooled may be prevented thereby a grinding stone having a superior structure may be manufactured.

Incidentally, the sintered product may be rapid-cooled at a falling rate of 10 to 20° C./minute in the temperature.

If the cooling rate is more than 10° C./minute, the agglomerates may be prevented from being created. If the cooling rate is less than 20° C./minute, additional equipments may not be installed.

Further, a content ratio of the copper tin alloy may be 20 to 40% by volume as a whole. A content ratio of the tungsten disulfide may be 0.25 to 0.5% by volume as a whole.

Other aspects and advantages of the invention will be apparent from the following description, the drawings and the claims.

DESCRIPTION OF EMBODIMENTS

Exemplary embodiments of the present invention will now be described with reference to the accompanying drawings. The drawings are assumed to be viewed in a direction of reference symbols. Pressure is designated by the following indications.

In a depressurized state, an absolute pressure is used in which an absolute vacuum is defined as zero, and its unit is followed by mark (a). In a pressurized state, a gage pressure is used in which atmospheric pressure is defined as zero, and its unit is followed by mark (G).

Figure 1:
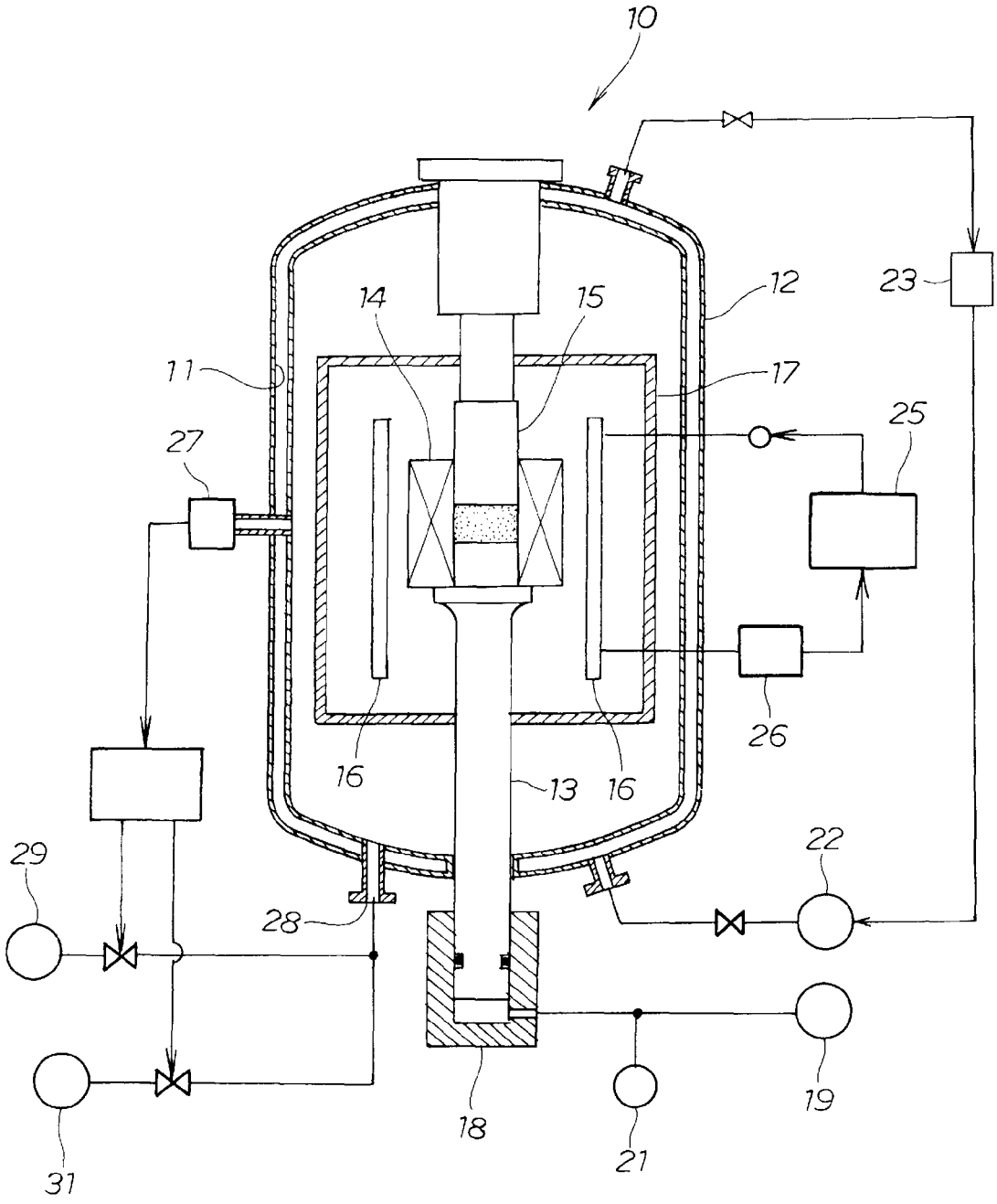
FIG. 1 is a cross sectional view showing a hot press used in an exemplary embodiment of the present invention.

As shown in FIG. 1, the hot press 10 is a sintering furnace provided with a water jacket 11, a furnace shell 12 sustained up to an internal pressure of 0.98 MPa(G), a lower punch inserted upwards from a bottom of the furnace shell 12, a cylinder shaped die 14 put on the lower punch 13, an upper punch 15 inserted downwards from a top of the furnace shell 12 thereby being inserted into the die 14, a graphite heater 16 arranged around the die 14, and a thermal insulation chamber 17 surrounding the graphite heater 16.

A lower portion of the lower punch 13 is inserted into a cylinder 18, and the lower punch 13 ascends when pressurized oil is supplied from a hydraulic pump 19 to the cylinder 18. An oil pressure is detected by a pressure detecting means 21. The water jacket 11 is supplied with water by a water pump 22. The supplied water is discharged into a chiller 23 so that a temperature is regulated, thereafter being returned to the water pump 22.

The graphite heater 16 is controlled by a furnace temperature control unit 25. That is, in a case where the temperature detected by a furnace temperature detection means 26 is less than a set temperature, a quantity of supplied electricity is allowed to increase, and, in a case where the temperature is higher than a set temperature, the quantity of supplied electricity is allowed to decrease, thereby becoming possible to control the furnace temperature including an increasing rate in temperature.

Also, the furnace shell 12 is installed with a furnace pressure detection means 27 detecting pressure in the furnace and a conduit 28 for both discharge and pressurization, and the conduit 28 is connected to a discharge means 29 such as a vacuum pump or ejector or the like and a non-volatile gas supply source 31. As the non-volatile gas, argon gas or nitrogen gas may easily be purchased. However, the discharge means 29 and non-volatile gas supply source 31 cannot simultaneously be employed.

Also, although it is preferable that the furnace pressure detection means 27 is provided separately for depressurization and pressurization, the present invention employs a furnace pressure detection means for common use. A test is performed as follows using the hot press 10 described above.

(Test Example)

A test example according to the present invention will be described below.

The present invention is not limited to the test example.

<Material>

Abrasive grains (average grain size 5 μm): 8.75 volume %

Cobalt: 56 volume %

Tungsten disulfide: 5.25 volume %

Binder (phosphor bronze): 30 volume %

<Filling with Material>

The above material fills the die 14 shown in FIG. 1. Meanwhile, a maximum diameter of the die 14 is 120 mm.

<Discharge>

To discharge air in the furnace, the furnace is depressurized therein to 20 Pa(a) or less by the discharge means 29 shown in FIG. 1. Thereby most oxygen therein is eliminated.

<Filling with Non-Volatile Gas>

Argon gas is infused into the furnace from a non-volatile gas supply source 31 shown in FIG. 1 to thereby maintain a pressure in the furnace at a predetermined pressure.

<Press>

A press pressure of 30 MPa is applied to the material by the punch 13, 15 shown in FIG. 1.

<Heating and Temperature Rising Rate>

The material is heated at a temperature rising rate of 12.5° C./minute from an atmospheric temperature (25° C.) to a sintering temperature (740° C.). The material is maintained at a temperature of 740° C. during a predetermined time, thereby a sintering process is completed.

<Heating Stop>

The operation of the graphite heater 16 shown in FIG. 1 stops. Thereby, the internal side of the furnace and the material is lowered in its temperature. When lowering the temperature, a pressure in the furnace is monitored by the furnace pressure detection means 27 to control the discharge means 29 and the non-volatile gas supply source 31 so that the non-volatile gas pressure in the furnace may be maintained.

The temperature falling rate is indicated in the drawings.

Figure 2:
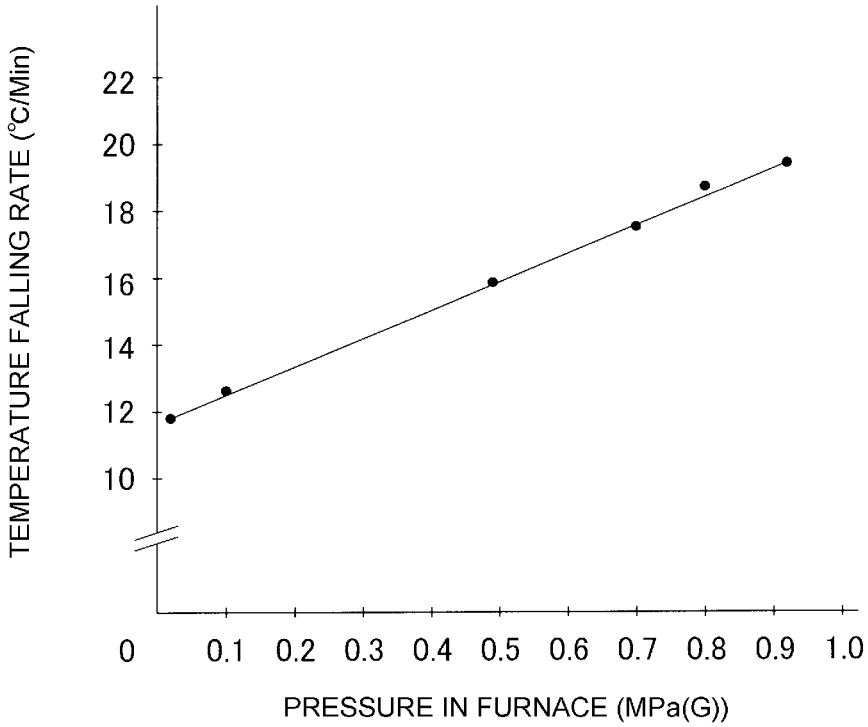
FIG. 2 is a correlation graph showing a pressure in a chamber and a falling rate of temperature.

As shown in FIG. 2, the temperature falling rate is 11.9° C./minute at a furnace pressure of 0.01 MPa, 12.8° C./minute at a furnace pressure of 0.10 MPa(G), 16.0° C./minute at a furnace pressure of 0.49 MPa(G), 17.5° C./minute at a furnace pressure of 0.69 MPa(G), 18.7° C./minute at a furnace pressure of 0.80 MPa(G), and 19.3° C./minute at a furnace pressure of 0.92 MPa(G), respectively.

Incidentally, the temperature falling rate is calculated by counting the duration from 740° C. to 600° C. and the formula (740-600)/duration=temperature falling rate.

The deference in the temperature falling rate may be explained as follows.

Cooling is transferring of heat from a center portion of higher temperature to a circumferential portion of lower temperature in the furnace. Material of transferring heat is atmosphere. In other words, such heat transfer is performed by collision of gas molecules.

According to a general hot press method, depressurization or gas exchange in the furnace is performed and oxygen partial pressure is lowered, thereafter, sintering is performed. This is to prevent its deterioration caused by oxidization from being occurred. In a depressurized atmosphere, heat transferring materials (gas molecules) become reduced. Also, during the gas exchange, although the kind of gas is changed, the number of gas molecules is scarcely changed. Accordingly, in an atmosphere of general hot press, the temperature falling rate is not enhanced.

According to the exemplary embodiment of the present invention, the hot press method is performed in a state where atmosphere in the furnace is pressurized and the temperature falling rate is thereby enhanced. High pressure gases are sealed in the furnace thereby increasing the number of gas molecules. That is, the present invention has succeeded in promotion of heat discharge by increasing the number of collisions of molecules.

<Estimation at 0.92 MPa(G)>

Figure 3:
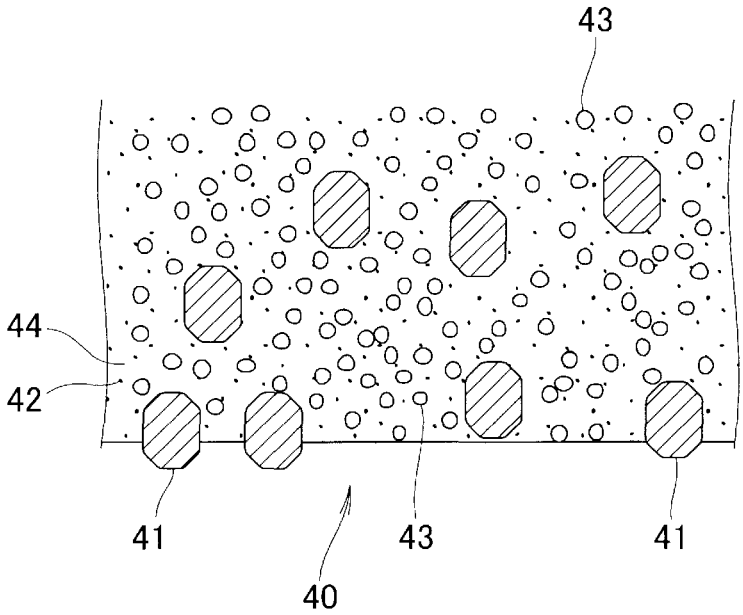
FIG. 3 is an enlarged sectional schematic view showing a grinding stone.

The cross section (schematic view) of a grinding stone prepared at an internal furnace pressure of 0.92 MPa(G) is follows. As shown in FIG. 3, the grinding stone 40 consists of abrasive grains 41, cobalt grains 42, tungsten disulfide grains 43, and metallic binder 44 binding these, and at the same time, the cobalt grains 42 marked with small dark points, tungsten disulfide grains 43 and abrasive grains 41 are evenly dispersed.

Figure 4:
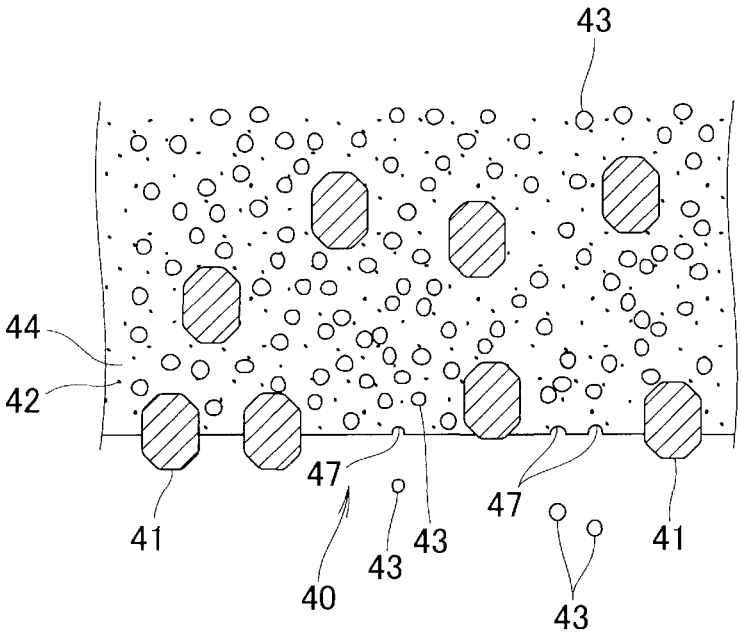
FIG. 4 is an enlarged sectional schematic view showing the grinding stone after being used.
Figure 5A:
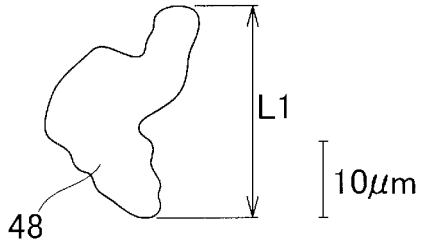
FIGS. 5 (*a*) to (*e*) are 3,000 times enlarged sketches showing the agglomerates in the grinding stone obtained during the experiments 1 to 5.
Figure 5B:
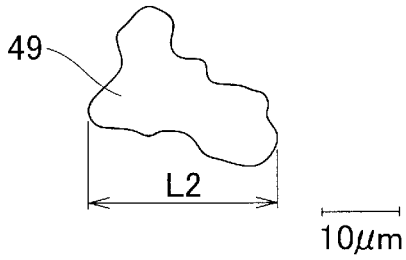
Figure 5C:
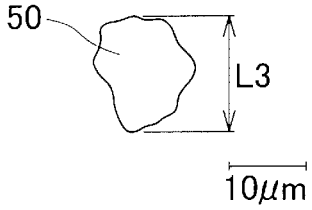
Figure 5D:
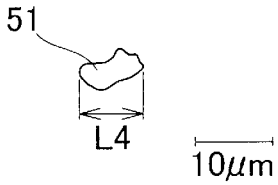
Figure 5E:
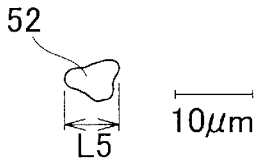

FIG. 4 is an operation view of a section of a grinding stone shown in FIG. 3. Grinding is performed with the grinding stone 40, as a result, a tungsten disulfide grain 43 is wandered from a surface thereof, and a fine pocket 47 is thereby created.

That is, the cobalt grains 42 enhancing wear resistance of abrasive grain play a role of preventing the grinding stone from being worn down while remaining in the grinding stone. The fine pocket 47 serves to prevent grinding powders from being deposited on a front face of abrasive grain, and the wandered tungsten disulfide grain 43 plays a role of a solid lubricant to promote the discharge property of cutting powders, thereby preventing loading of cutting powders. In such a manner, a superior cutting property is maintained.

<Estimation at an Atmospheric Pressure (0.01 MPa(G))>

Figure 11:
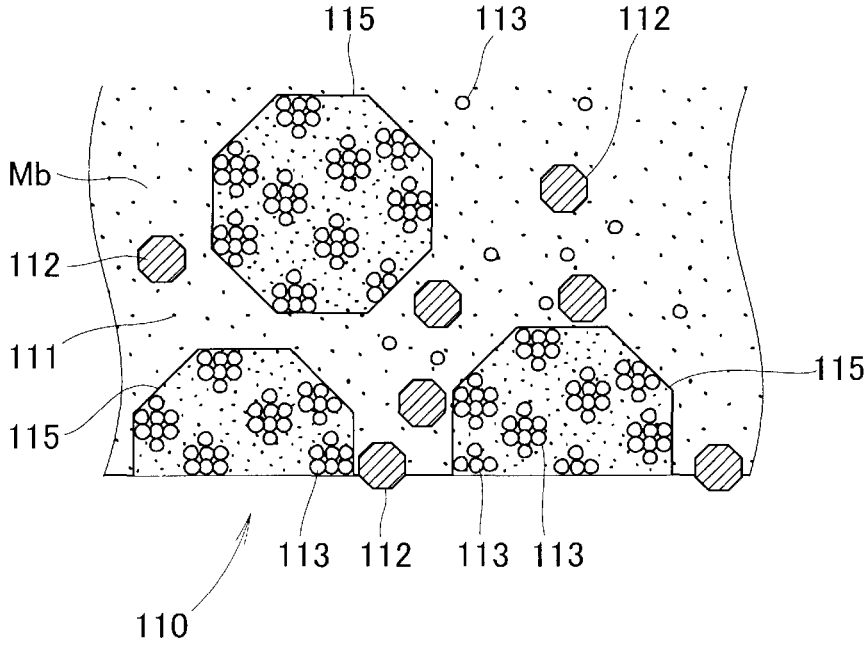
FIG. 11 is an enlarged sectional schematic diagram of a related grinding stone.
Figure 12:
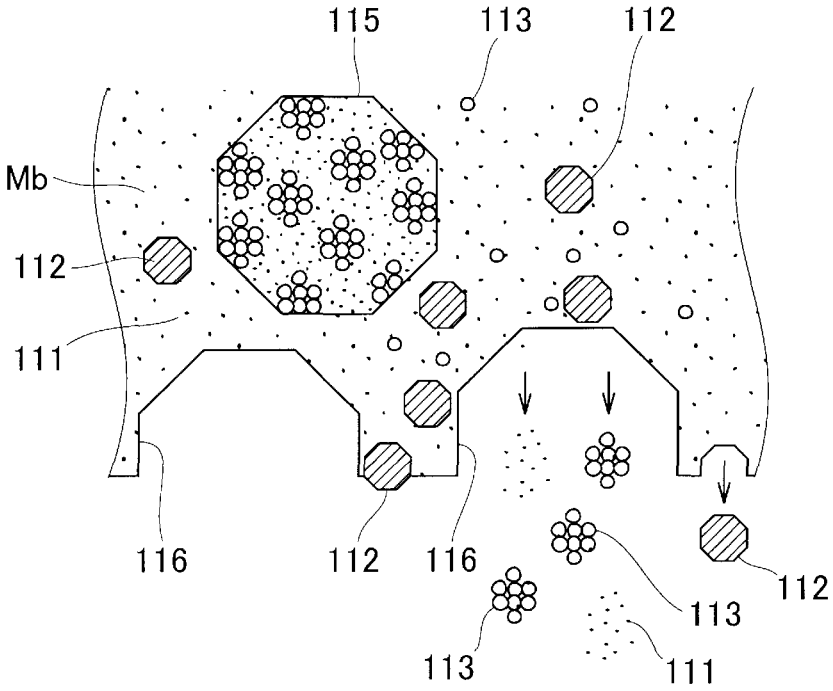
FIG. 12 is an enlarged sectional schematic diagram showing the grinding stone after being used.

The cross section (schematic view) of a grinding stone prepared at an atmospheric pressure of 0.01 MPa(G) is substantially identical to that shown in FIG. 11 according to a related art, and has the same problem as that shown in FIG. 12.

According to the exemplary embodiment of the present invention, after sintering, the grinding stone is rapid-cooled at a rapidly falling rate of temperature, and thereby, the size of the agglomerates 115 shown in FIG. 11 may be minified.

As described above, it can be found that the size of the agglomerates may be minified in proportion to a temperature falling rate.

Next, an additional test will be performed to examine a correlation of a temperature falling rate and the size of agglomerate.

<Tests 1 to 5>

As indicated in Table 2, the temperature falling rate is set as 5.8 to 26.4° C./minute, and a grinding stone is prepared in a test condition indicated in the foregoing (Test Example). In FIG. 2, the temperature falling rate is 11.9 to 19.3° C./minute. However, if a large-sized die is used, the temperature falling rate may be lowered, if a small sized die is used, the temperature falling rate may be increased. Also, if a thickness of thermal insulation material forming the thermal insulation chamber 17 is changed and the kind thereof is changed, the temperature falling rate may also be regulated. In such a manner, a temperature falling rate of 5.8 to 26.4° C./minute can be realized.

TABLE 2

| Test number | Temperature falling rate | Size of agglomerate | Grinding ratio |
|---|---|---|---|
| Test 1 | 5.8° C./minute | 30 μm | 502 |
| Test 2 | 7.8° C./minute | 25 μm | 754 |
| Test 3 | 10.8° C./minute | 16 μm | 992 |
| Test 4 | 18.6° C./minute | 8 μm | 2569 |
| Test 5 | 26.4° C./minute | 8 μm | 2442 |

A surface of the grinding stone thus obtained is examined at a magnification of 3,000 times by SEM. FIGS. 5(*a*) to (*e*) are enlarged sketch diagram magnifying 3,000 times the agglomerates existing in the grinding stone obtained during Tests 1 to 5. FIG. 5(*a*) is a sketch view concerning Test 1, in which a quite large agglomerate 48 has been found. The size L1 (maximum grain size) of the agglomerate 48 is 30 μm. This size is substantially identical to the average size of a number of agglomerates 48 dispersed. Accordingly, the size is designated as 30 μm in Table 2.

FIG. 5(*b*) is a sketch diagram concerning Test 2, in which the average size L2 of the agglomerates 49 is 25 μm. FIG. 5(*c*) is a sketch diagram concerning Test 3, in which the average size L3 of the agglomerates 50 is 16 μm. FIG. 5(*d*) is a sketch diagram concerning Test 4, in which the average size L4 of the agglomerates 51 is 8 μm. FIG. 5(*e*) is a sketch diagram concerning Test 5, in which the average size L5 of the agglomerates 52 is 8 μm.

Incidentally, in a case where a work piece is grinded with a grinding stone, the work piece is grinded and only a predetermined volume of the work piece is thereby eliminated. This volume is called a grinding volume. Also, a portion of the grinding stone is somewhat worn out in its volume. This volume is called a wear volume. It is defined as (grinding volume/wear volume)=grinding ratio. Since the grinding ratio indicates a life of the grinding stone itself, a grinding stone having a great grinding ratio is preferable. That is, it is preferable that an abrasion loss of a grinding stone is few and a grinding rate of work piece by the grinding stone is great.

Figure 6A:
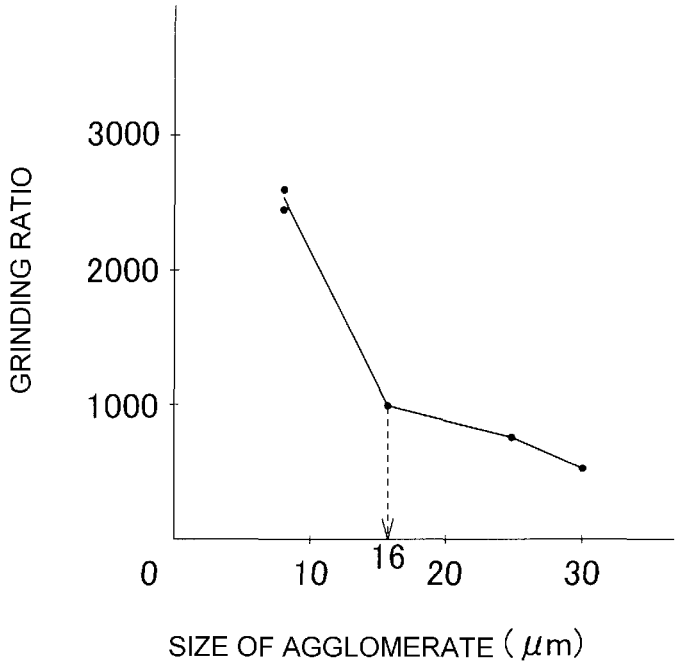
FIG. 6(*a*) is a correlation graph showing the size of agglomerates and the grinding ratio and FIG. 6 (*b*) is a correlation graph showing the falling rate of temperature and the size of agglomerates.
Figure 6B:
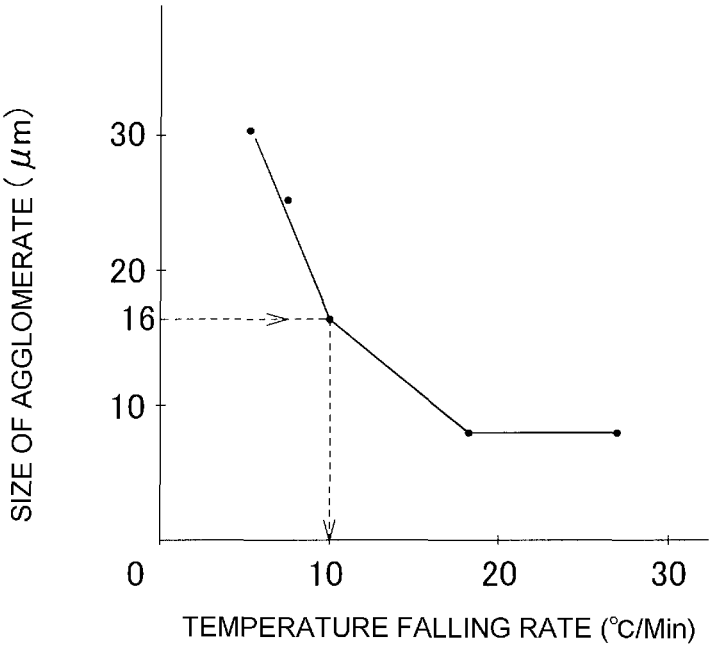

During Tests 1 to 5, grinding ratios have been examined using a grinding stone and values indicated in Table 2 are thereby obtained. The correlation of the sizes of agglomerates and the grinding ratio has been made in a graph as shown in FIG. 6(*a*). As shown in FIG. 6(*a*), the smaller the size of the agglomerate, the more the grinding ratio increases. The graph shows that there is a singular point where the size of the agglomerate is 16 μm on a horizontal axis and a higher grinding ratio may be obtained when the size of agglomerate is less than 16 μm.

When the size of agglomerate is less than 15 μm, about 1 μm smaller than 16 μm, a grinding ratio of 1,000 may be obtained. Also, if less than 10 μm, a grinding ratio of more than 2,000 may be obtained. Accordingly, if the sizes of agglomerates unavoidably dispersed in the grinding stone are less than 15 μm, preferably 10 μm, a premium grinding ratio may be obtained.

Incidentally, FIG. 6(*b*) is a graph showing the correlation of the temperature falling rate and the size of agglomerate. As indicated by a broken line, there is a need to increase the temperature falling rate to more than 10° C./minute so that the average size of agglomerates may be 16 μm. However, if the temperature falling rate is more than 18.6° C./minute, the size of agglomerate is hardly changed during Test 4. Since increasing a temperature falling rate burdens a user with additional equipments, it is preferable that 20° C./minute is set as its upper limit. Accordingly, the preferable temperature falling rate is 10 to 20° C.

An additional test has been performed to determine an appropriate content ratio of molten substance (phosphor bronze).

<Tests 6 to 8>

As shown in Table 3, in Test 6, the grinding stone is prepared under the test conditions (filling with material, discharging, filling with non-volatile gas, press, heating and temperature rising rate, heating stop) indicated in the foregoing (Test Example) with the content ratio of phosphor bronze (Cu—Sn—P) 20%, abrasive grains 8.75%, cobalt grains 57.70%, and tungsten disulfide 13.55%, all by volume (here, the atmosphere is 0.92 MPa(G), and the temperature falling rate is 18.2° C./minute).

Incidentally, when the work piece is processed during a predetermined time, the more the grinding volume is, the higher the productivity is. Accordingly, it is defined as grinding efficiency=(grinding volume/process time). The unit of the grinding efficiency is set as mm3/sec.

TABLE 3

| Test No. | Molten substance Cu—Sn—P | Non-molten substance Abrasive grain | cobalt | Tungsten disulfide | WS2/Co | Grinding ratio | Grinding efficiency |
|---|---|---|---|---|---|---|---|
| Test 6 | 20% | 8.75% | 57.70% | 13.55% | 23.4% | 660 | 7.9 |
| Test 7 | 30% | 8.75% | 56.00% | 5.2% | 9.4% | 1000 | 9.3 |
| Test 8 | 40% | 8.75% | 46.80% | 4.45% | 9.5% | 630 | 7.5 |

In Test 6, the grinding ratio is 660 and the grinding efficiency is 7.9 mm3/sec. In Tests 7 and 8, the content ratio of tungsten disulfide is lowered and the results as indicated in Table 3 are obtained. The grinding ratio and grinding efficiency in Tests 6 to 8 are graphed as follows.

Figure 7A:
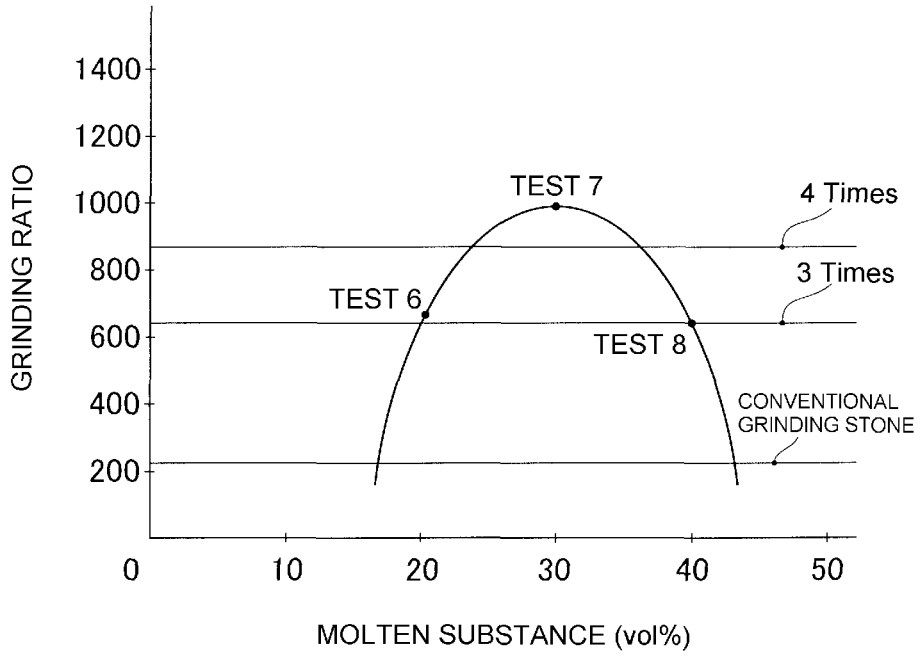
FIGS. 7(*a*) and 7(*b*) are graphs showing the results of experiments 6 to 8, FIG. 7(*a*) is a correlation graph showing the quantity of molten substances and the grinding ratio and FIG. 7(*b*) is a correlation graph showing the quantity of molten substances and the grinding efficiency.
Figure 7B:
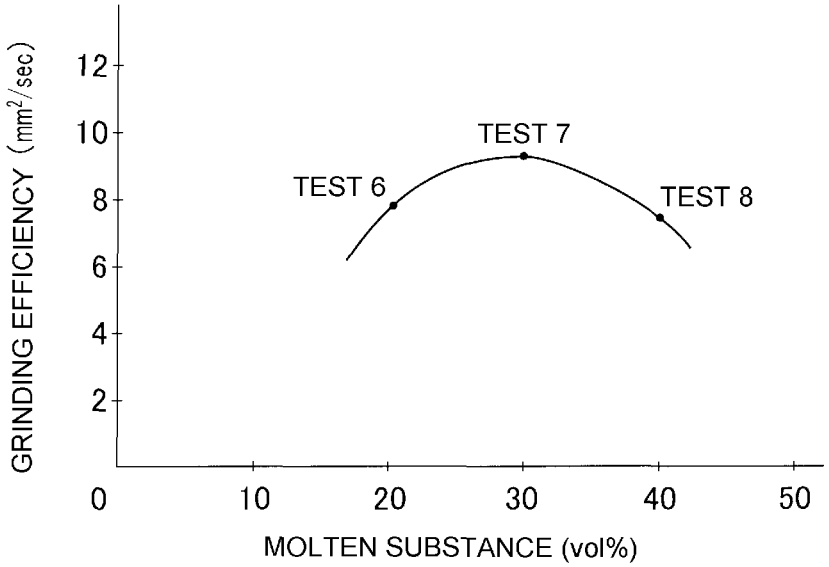

As shown in FIGS. 7(*a*) and 7(*b*), both the grinding ratio and the grinding efficiency peak when the molten substance is 30% by volume. In FIG. 7(*a*), it is described that the grinding ratio of a conventional grinding stone is 210. If a horizontal line is plotted by 3 times this value, the molten substance having a grinding ratio of 630 is in the range of 20 to 40% by volume. Also, if a horizontal line is plotted by 4 times this value, the molten substance having a grinding ratio of 840 is in the range of 24 to 36% by volume.

Tests 6 to 8 indicate that the ratio of tungsten disulfide/cobalt appearing in column of WS2/Co is more than 9.0%. After lowering the content ratio of tungsten disulfide, tests 9 to 12 are performed.

<Tests 9 to 12>

As shown in Table 4, in Test 9, the grinding stone is prepared under the test conditions indicated in the foregoing (Test Example) with the content ratio of phosphor bronze (Cu—Sn—P) 20%, abrasive grains 8.75%, cobalt grains 67.70%, tungsten disulfide 3.55%, all by volume (Here, the atmosphere is 0.92 MPa(G), and the temperature falling rate is 18.2° C./minute).

TABLE 4

| Test No. | Molten substance Cu—Sn—P | Non-molten substance Abrasive grain | cobalt | Tungsten disulfide | WS2/Co | Grinding ratio | Grinding efficiency |
|---|---|---|---|---|---|---|---|
| Test 9 | 20% | 8.75% | 67.70% | 3.55% | 5.2% | 920 | 7.5 |
| Test 10 | 20% | 8.75% | 70.20% | 1.05% | 1.5% | 910 | 7.3 |
| Test 11 | 30% | 8.75% | 61.00% | 0.25% | 0.4% | 1630 | 11.8 |
| Test 12 | 40% | 8.75% | 49.30% | 1.95% | 4.0% | 600 | 9.2 |

In Test 9, the grinding ratio is 920 and the grinding efficiency is 7.5 mm3/sec. In Tests 10 to 12, the content ratio of tungsten disulfide is further lowered and the results as indicated in Table 4 are obtained. In Tests 9 to 12, the grinding ratio and grinding efficiency are graphed as follows.

Figure 8A:
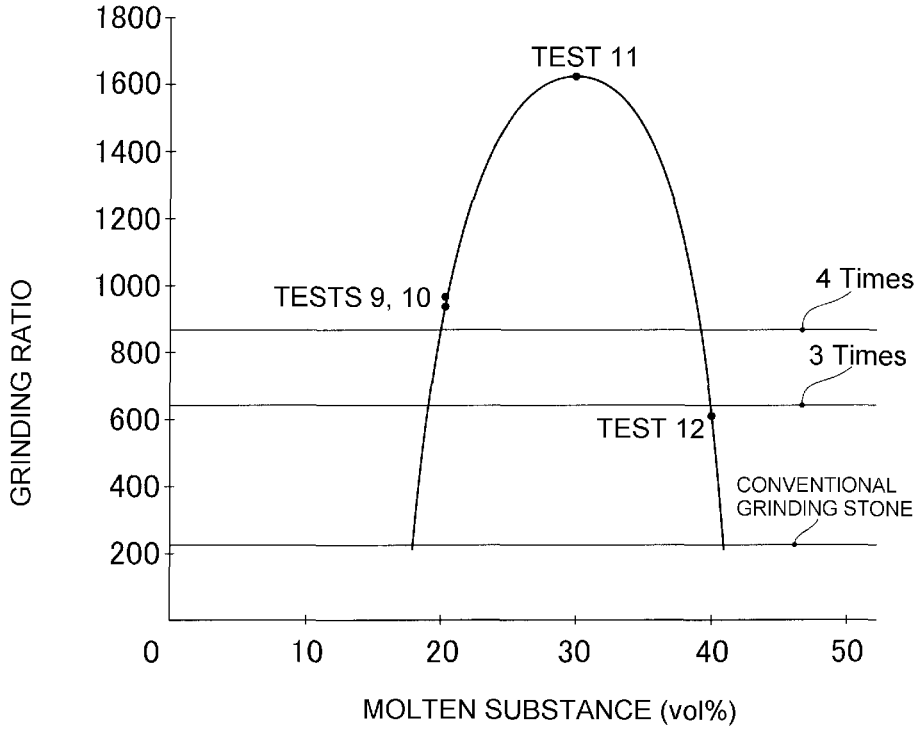
FIGS. 8(*a*) and (*b*) are graphs showing the results of experiments 9 to 12, FIG. 8(*a*) is a correlation graph showing the quantity of molten substances and the grinding ratio and FIG. 8(*b*) is a correlation graph showing the quantity of molten substances and the grinding efficiency.
Figure 8B:
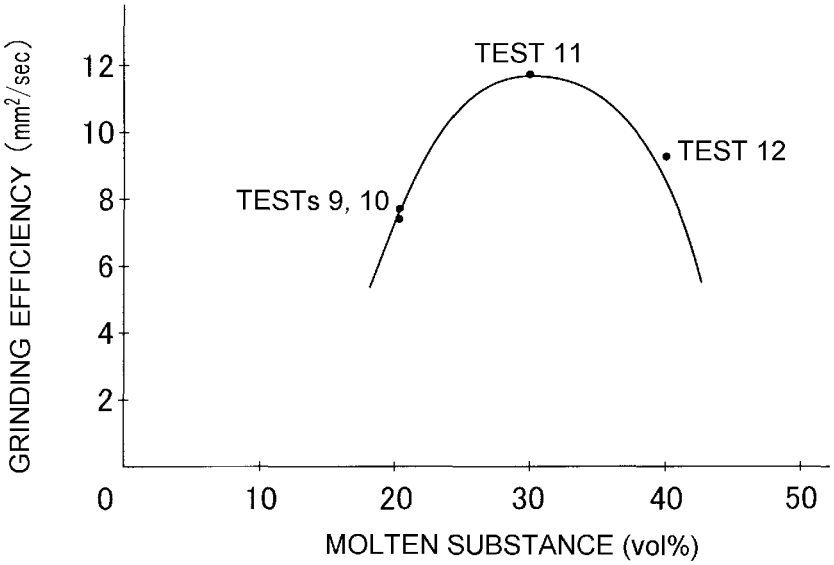

As shown in FIGS. 8(*a*) and 8(*b*), both the grinding ratio and the grinding efficiency peak when the molten substance is 30% by volume. In FIG. 8(*a*), it is described that the grinding ratio of a conventional grinding stone is 210. If a horizontal line is plotted by 3 times this value, the molten substance having a grinding ratio of 630 is in the range of 18 to 40% by volume. Also, if a horizontal line is plotted by 4 times this value, the molten substance having a grinding ratio of 840 is in the range of 20 to 38% by volume.

If FIG. 7(*a*) and FIG. 8(*a*) are overlapped, it can be found the fact that the grinding ratio 3 times larger than the conventional grinding ratio may be obtained when the molten substance is in the range of 20 to 40% by volume. This fact will be reviewed as follows. The molten substance (phosphor bronze) represented in Tables 3 and 4 is a binder connecting the non-molten substances to each other (abrasive grains, cobalt grains, tungsten disulfide grains). Since it is most preferable that the molten substance is 30% by volume, it can be presumed that the space ratio (coincide with a space occupied by binders) of the non-molten substances is about 30% by volume.

If the molten substances under 20% by volume exist in a space of such 30 volume %, chinks (blowholes) are generated by 10 volume %. The more the chinks (blowholes) exist, the less the performance of the grinding stone. Also, although the molten substances of more than 40 volume % try to penetrate into the space of 30 volume %, the quantity of 10 volume % thereof remains as an excessive quantity and the excessive quantity thereof becomes a harmful inclusion. This inclusion causes an even dispersion of the non-molten substances to be hindered. Accordingly, the performance of the grinding stone is lowered.

Incidentally, the copper tin alloy may be free-machining phosphor bronze other than phosphor bronze, i.e., it is no matter what kind of alloy is used only if the alloy is an alloy of copper and tin, or, an alloy of copper, tin and other elements.

Also, an additional test has been performed to determine an appropriate content ratio of tungsten disulfide.

<Tests 13 to 17>

As shown in Table 5 which will be described later, the grinding stone is prepared under the test conditions (filling with material, discharging, filling with non-volatile gas, press, heating and temperature rising rate, heating stop) indicated in the foregoing (Test Example) with the content ratio of abrasive grains 8.75%, cobalt grains 58.50 to 61.25%, tungsten disulfide 0 to 2.75%, and phosphor bronze (Cu—Sn—P) 30%, all by volume (here, the atmosphere is 0.92 MPa(G), and the temperature falling rate is 18.2° C./minute).

Meanwhile, the sintered product unavoidably includes fine blowholes therein, but its life is lowered if the blowhole is large in the size or the number. The content ratio of the blowholes may be estimated by the blowhole ratio. The blowhole ratio (volume ratio; unit is %) means (sum of blowhole volumes)/(apparent volume of grinding stone), and calculated by its theoretical density and actual measurement value of the grinding stone.

TABLE 5

| Test No. | Non-molten substances: Abrasive grain | Cobalt | Tungsten disulfide | Molten substances Cu—Sn—P | Results: Grinding ratio | Grinding efficiency | Blowhole ratio |
|---|---|---|---|---|---|---|---|
| Test 13 | 8.75% | 61.25% | 0% | 30% | 2202 | 6.6 | 1.07% |
| Test 14 | 8.75% | 61.13% | 0.125% | 30% | 2369 | 7.1 | 0.74% |
| Test 15 | 8.75% | 61.00% | 0.250% | 30% | 2629 | 8.1 | 0.74% |
| Test 16 | 8.75% | 60.75% | 0.500% | 30% | 2670 | 8.1 | 0.72% |
| Test 17 | 8.75% | 58.50% | 2.75% | 30% | 2469 | 7.5 | 0.76% |

In Test 13 in which the content ratio of tungsten disulfide is 0, the grinding ratio is 2202, the grinding efficiency is 6.6 mm3/sec, and the blowhole ratio is 1.07%. In Tests 14 to 17 performed by raising the content ratio of tungsten disulfide, the results indicated in Table 5 are obtained. In Tests 13 to 17, the grinding ratio and grinding efficiency may be graphed as follows.

Figure 9A:
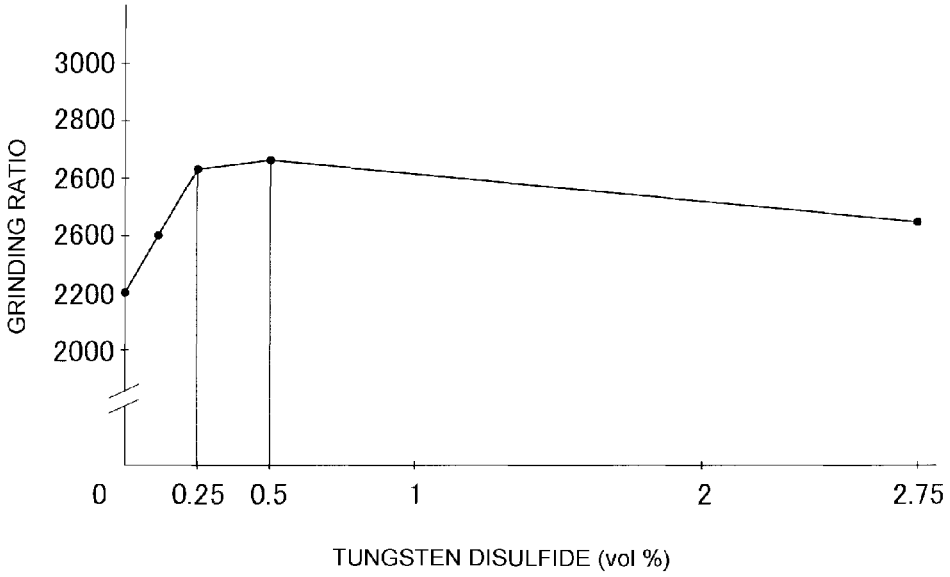
FIG. 9(*a*) and (*b*) are graphs showing the results of experiments 13 to 17, FIG. 9(*a*) is a correlation graph showing the quantity of tungsten disulfide and the grinding ratio and FIG. 9(*b*) is a correlation graph showing the quantity of tungsten disulfide and the grinding efficiency.
Figure 9B:
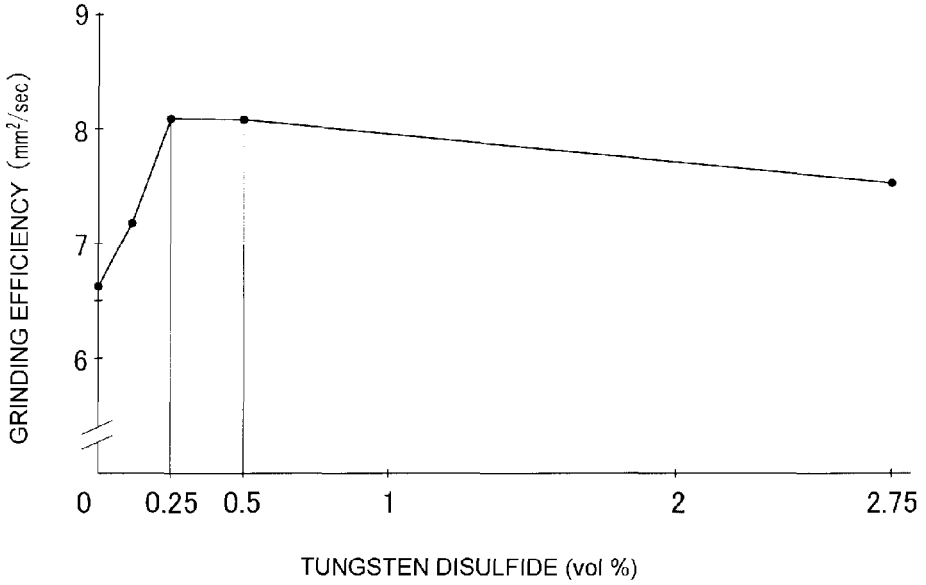
Figure 10:
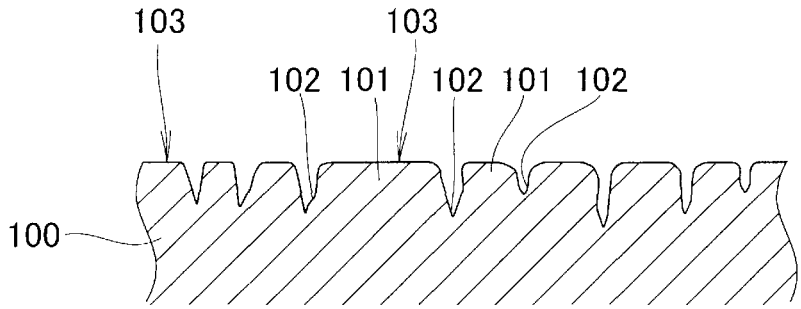
FIG. 10 is an enlarged sectional schematic diagram showing a cylinder having been plateau honing processed.

As shown in FIG. 9(*a*), in a case where the content ratio of tungsten disulfide is 0 to 0.25% by volume, the grinding ratio suddenly increases in proportion to the content ratio of tungsten sulfide. When the content ratio of tungsten sulfide is 0.5 to 2.75% by volume, the grinding ratio decreases in proportion to the content ratio of tungsten disulfide. That is, when the content ratio of tungsten disulfide is in the range of 0.25 to 0.5% by volume, a maximum grinding ratio may be obtained.

In addition, as shown in FIG. 9(*b*), in a case where the content ratio of tungsten disulfide is 0 to 0.25% by volume, the grinding ratio suddenly increases in proportion to the content ratio of tungsten sulfide. When the content ratio of tungsten sulfide is 0.5 to 2.75% by volume, the grinding efficiency decreases in proportion to the content ratio of tungsten disulfide. That is, when the content ratio of tungsten disulfide is in the range of 0.25 to 0.5% by volume, a maximum grinding efficiency may be obtained.

When the content ratio of tungsten disulfide is in the range of 0.25 to 0.5% by volume, it can be seen that the tungsten disulfide effectively affects both acceleration in the formation of chip pockets and acceleration in discharging of cutting scraps.

Also, as shown in Table 5, the blowhole ratio in Tests 14 to 17 is in the range of 0.72 to 0.76% by volume, which has been improved by about 30% compared with Test 13. Accordingly, the tungsten sulfide has an effect of controlling formation of blowholes

INDUSTRIAL APPLICABILITY

The present invention is suitable for a metal bonded grinding stone used in a plateau honing process.

Description of Reference Numerals and Signs:

10 . . . Hot Press, 11 . . . Water Jacket, 31 . . . Non-volatile Gas Supply Source, 40 . . . Grinding Stone, 41 . . . Abrasive Grain, 42 . . . Cobalt Grain, 43 . . . Tungsten Disulfide Grain, 44 . . . Metallic Binder, 48-52 . . . Agglomerate, L1-L5 . . . Size of Agglomerate (average size)

The invention claimed is:

1. A metal bonded grinding stone, comprising:
abrasive grains;
a cobalt;
a tungsten disulfide; and
a metallic binder,
wherein a content ratio of the tungsten disulfide is 0.25 to 0.5% by volume as a whole.

2. The metal bonded grinding stone according to claim 1, wherein the metallic binder comprises a copper tin alloy, and
wherein a content ratio of the copper tin alloy is 20 to 40% by volume as a whole.

3. The metal bonded grinding stone according to claim 2, wherein the copper tin alloy comprises phosphor bronze.

* * * * *